US009329540B2

(12) United States Patent
Kondo

(10) Patent No.: US 9,329,540 B2
(45) Date of Patent: May 3, 2016

(54) FIXING DEVICE THAT DETERMINES ROTATION STATE OF ROTATORY BODY BASED ON POSITION OF OUTER CIRCUMFERENTIAL SURFACE OF ROTATORY BODY IN TERMS OF RADIAL DIRECTION AND IMAGE FORMING APPARATUS INCLUDING FIXING DEVICE

(71) Applicant: KYOCERA Document Solutions Inc., Osaka-shi (JP)

(72) Inventor: Akihiro Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/721,376

(22) Filed: May 26, 2015

(65) Prior Publication Data

US 2015/0346656 A1 Dec. 3, 2015

(30) Foreign Application Priority Data

May 27, 2014 (JP) ..... 2014-109115

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2046; G03G 15/205; G03G 15/2053; G03G 2215/2029; G03G 2215/2035
USPC ..... 399/33, 67, 329
See application file for complete search history.

(56) References Cited

U.S. PATENT DOCUMENTS 7,761,045 B2 * 7/2010 Fujimori et al. ... G03G 15/2053 399/329
8,346,146 B2 * 1/2013 Yamada ..... G03G 15/2064 399/329
8,639,131 B2 * 1/2014 Peng et al. ..... G03G 15/2032 399/33

FOREIGN PATENT DOCUMENTS

JP 2010-276758 A 12/2010

* cited by examiner

*Primary Examiner* — William J Royer
(74) *Attorney, Agent, or Firm* — Studebaker & Brackett PC

(57) ABSTRACT

A fixing device includes a first rotatory body, a heater, a pressure receiving member, a supporting member, a second rotatory body, a position detection section, and a determination section. The position detection section detects a position of an outer circumferential surface of the first rotatory body in terms of a radial direction. The determination section determines a rotation state of the first rotatory body based on a result of detection by the position detection section. The position detection section includes a first position detection member and a second position detection member. The first position detection member is located upstream of a fixing nip in terms of a rotation direction of the first rotatory body. The second position detection member is located downstream of the fixing nip in terms of the rotation direction.

8 Claims, 9 Drawing Sheets

FIXING DEVICE THAT DETERMINES ROTATION STATE OF ROTATORY BODY BASED ON POSITION OF OUTER CIRCUMFERENTIAL SURFACE OF ROTATORY BODY IN TERMS OF RADIAL DIRECTION AND IMAGE FORMING APPARATUS INCLUDING FIXING DEVICE

INCORPORATION BY REFERENCE

The present application claims priority under 35 U.S.C. §119 to Japanese Patent Application No. 2014-109115, filed May 27, 2014. The contents of this application are incorporated herein by reference in their entirety.

BACKGROUND

The present disclosure relates to a fixing device and an image forming apparatus.

An electrophotographic image forming apparatus includes a fixing device that fixes toner on a recording medium. The fixing device for example fixes toner by applying heat and pressure onto the recording medium while the recording medium carrying unfixed toner is passing through a fixing nip formed between a pressure roller and an endless rotatory heating belt. For example, a heater that heats the fixing nip is provided inside of the rotatory heating belt.

The rotatory heating belt is prone to deformation if heated by the heater while in a suspended state. In case of abnormal rotation of the rotatory heating belt, therefore, it is necessary to stop the heating by the heater as early as possible.

For example, a certain fixing device can determine the state of rotation of a rotatory heating belt (a first rotatory body) through periodic detection of a position of the outer circumferential surface of the first rotatory body in terms of a radial direction using a sensor.

SUMMARY

A fixing device according to the present disclosure fixes a toner on a recording medium. The fixing device includes a first rotatory body, a heater, a pressure receiving member, a supporting member, a second rotatory body, a position detection section, and a determination section. The first rotatory body is in the form of an endless belt and is rotatable in a circumferential direction thereof. The heater heats the first rotatory body. The pressure receiving member is disposed within the first rotatory body and is in contact with an inner circumferential surface of the first rotatory body. The supporting member is disposed within the first rotatory body and supports the pressure receiving member. The second rotatory body is rotatable. The second rotatory body is disposed opposite to the pressure receiving member with the first rotatory body therebetween. The second rotatory body and the pressure receiving member provide a fixing nip therebetween where the recording medium becomes sandwiched. The position detection section detects a position of an outer circumferential surface of the first rotatory body in terms of a radial direction of the first rotatory body. The determination section determines a state of rotation of the first rotatory body based on a result of detection by the position detection section. The position detection section includes a first position detection member and a second position detection member. The first position detection member is located upstream of the fixing nip in terms of a rotation direction of the first rotatory body. The second position detection member is located downstream of the fixing nip in terms of the rotation direction.

An image forming apparatus according to the present disclosure includes the above-described fixing device and an image forming section. The image forming section transfers the toner to the recording medium. The fixing device fixes the toner on the recording medium.

DETAILED DESCRIPTION

Figure 1:
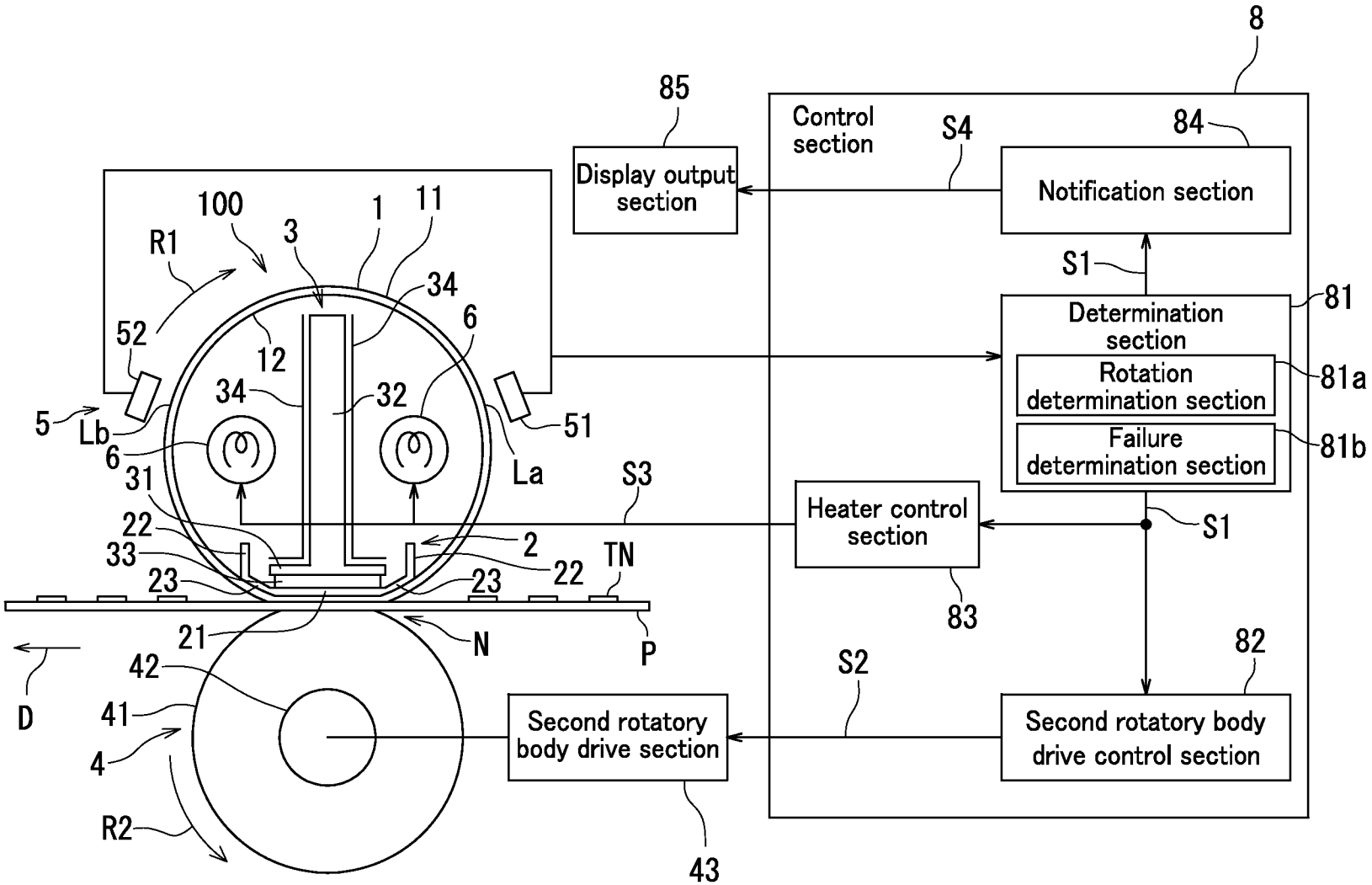
FIG. 1 is a block diagram illustrating functions of a fixing device according to a first embodiment of the present disclosure.

Hereinafter, embodiments of the present disclosure will be described with reference to the accompanying drawings. It should be noted that elements in the drawings that are the same or equivalent are labelled using the same reference signs and description thereof is not repeated.

First Embodiment

A fixing device 100 according to a first embodiment of the present disclosure will be described with reference to FIG. 1. FIG. 1 is a block diagram illustrating functions of the fixing device 100 according to the first embodiment of the present disclosure.

The fixing device 100 includes a first rotatory body 1, a second rotatory body 4, two heaters 6, a pressure receiving member 2, a supporting member 3, a position detection section 5, and a control section 8. The fixing device 100 is mounted in an image forming apparatus, for example. The fixing device 100 applies heat and pressure to a recording medium P to melt and fix toner TN on the recording medium P.

The first rotatory body 1 is a hollow cylindrical rotatory heating belt. The first rotatory body 1 is in a roll form (an endless belt form) and is heat resistant. The first rotatory body 1 is rotatable in a circumferential direction (rotation direction R1) about a rotation axis extending in a direction perpendicular to a conveyance direction D of the recording medium P. The first rotatory body 1 is formed from a plurality of layers stacked on one another. The plurality of layers include a metal layer, an elastic layer, and a release layer. The elastic layer is disposed over an outer circumferential surface of the metal layer. The release layer is disposed over an outer circumferential surface of the elastic layer. The metal layer is for example a steel use stainless (SUS) film having a thickness of 30 μm. The elastic layer is a silicone rubber film having a thickness of 0.3 mm. The release layer is a heat resistant fluororesin film of PFA (tetrafluoroethylene-perfluoroalkylvinylether copolymer) or PTFE (polytetrafluoroethylene) having a thickness of 30 μm.

The second rotatory body 4 is a solid cylindrical pressure roller. The second rotatory body 4 includes an outer circumferential surface 41 and a roller shaft 42. The second rotatory body 4 is rotatable about the roller shaft 42 (rotation axis). The roller shaft 42 is in parallel with the rotation axis of the first rotatory body 1. Hereinafter, a direction along the rotation axis of the first rotatory body 1 and the roller shaft 42 of the second rotatory body 4 is referred to simply as an "axial direction". The second rotatory body 4 includes a metal core, an elastic layer, and a release layer. The elastic layer is disposed over an outer circumferential surface of the metal core. The release layer is disposed over an outer circumferential surface of the elastic layer. The metal core is for example an aluminum or iron member having a diameter of 14 mm. The elastic layer is a silicone rubber film having a thickness of 5.5 mm. The release layer is a fluororesin film such as PFA or PTFE having a thickness of 50 μm. The roller shaft 42 is directly connected with a second rotatory body drive section 43 that rotationally drives the second rotatory body 4. The second rotatory body drive section 43 is for example an electric motor.

The outer circumferential surface 41 is disposed in contact with an outer circumferential surface 11 of the first rotatory body 1. The first rotatory body 1 is driven to rotate by the rotation of the second rotatory body 4. Thus, the first rotatory body 1 and the second rotatory body 4 form a fixing nip N therebetween where a recording medium P onto which toner TN has been transferred becomes sandwiched. The exterior of the first rotatory body 1 opposite to the fixing nip N and the exterior of the first and second rotatory bodies 1 and 4 at opposite axial ends thereof are enclosed by a housing.

The two heaters 6 heat the fixing nip N. The heaters 6 include a halogen heater or a ceramic heater, for example. One of the two heaters 6 is located downstream of the supporting member 3 in terms of the conveyance direction D within the first rotatory body 1, and the other is located upstream of the supporting member 3. The heaters 6 apply heat to the recording medium P being conveyed through the fixing nip N via the first rotatory body 1. The toner TN transferred onto the recording medium P is melted and fixed thereon while the recording medium P is passing through the fixing nip N.

The pressure receiving member 2 has a C-shape that opens, in a cross-sectional view in the axial direction, to the center of the first rotatory body 1 in terms of the radial direction. More specifically, the pressure receiving member 2 has a sliding contact plate section 21, two side plate sections 22, and two canted plate sections 23. The sliding contact plate section 21 is disposed in parallel with the fixing nip N. The two side plate sections 22 extend perpendicularly relative to the sliding contact plate section 21. Each of the two canted plate sections 23 connects one of the side plate sections 22 to one of the opposite ends of the sliding contact plate section 21 which is parallel to the conveyance direction D of the recording medium P. The pressure receiving member 2 is formed from a steel use stainless (SUS) member having a thickness of 0.2 mm, for example. The pressure receiving member 2 extends along the axial direction within the first rotatory body 1. Opposite ends of the pressure receiving member 2 in terms of the axial direction are secured to the housing.

The pressure receiving member 2 and the second rotatory body 4 form the fixing nip N with the first rotatory body 1 therebetween. An inner circumferential surface 12 of the first rotatory body 1 slides on the sliding contact plate section 21 and the canted plate sections 23 at a lower section of the first rotatory body 1 as the first rotatory body 1 rotates. The pressure receiving member 2 needs to have a certain degree of strength for receiving pressure from the second rotatory body 4 onto the first rotatory body 1. The pressure receiving member 2 preferably has high heat capacity, high heat resistance, and high abrasion resistance since the pressure receiving member 2 is in contact with the inner circumferential surface 12 of the first rotatory body 1. The pressure receiving member 2 is formed from SUS, for example. Alternatively, the pressure receiving member 2 may be formed from a resin.

The supporting member 3 is substantially T-shaped (has a shape including a T-shape) in a cross-sectional view in the axial direction. More specifically, the supporting member 3 includes a lower-end plate section 31 and a standing plate section 32, a heat insulating member 33, and a reflection member 34. The supporting member 3 is formed from a SUS member having a thickness of 3 mm, for example. The lower-end plate section 31 is disposed on the sliding contact plate section 21 of the pressure receiving member 2 with the heat insulating member 33 therebetween. The standing plate section 32 extends through the center of the first rotatory body 1 in terms of the radial direction to a position close to the inner circumferential surface 12 of the first rotatory body 1 at a section of the first rotatory body 1 that is opposite to the fixing nip N. A surface of the lower-end plate section 31 and opposite surfaces of the standing plate section 32 are entirely covered by the reflection member 34. The reflection member 34 is formed from an aluminum or gold film having a thickness of 0.5 mm, for example. The reflection member 34 reflects radiation heat from the heaters 6 in order to prevent light-heat conversion of the radiation heat. The heat insulating member 33 is for example formed from heat resistant silicone sponge, silicone fiber processed fabric, or glass wool having a thickness of 2 mm. The heat insulating member 33 prevents heat transfer from the pressure receiving member 2 to the supporting member 3.

Like the pressure receiving member 2, the supporting member 3 extends along the axial direction, and opposite ends thereof in terms of the axial direction are secured to the housing. The supporting member 3 is disposed within the first rotatory body 1. The supporting member 3 receives pressure from the second rotatory body 4 onto the pressure receiving member 2 and supports the pressure receiving member 2. As a result, the pressure (fixing pressure) at the fixing nip N is stabilized, and thus sufficient pressure is applied to the recording medium P passing through the fixing nip N. Friction (sliding) between the first rotatory body 1 and the second rotatory body 4 at the fixing nip N causes slack and tension of the outer circumferential surface 11 of the first rotatory body 1. The slack is more likely to be caused at a section of the outer circumferential surface 11 that is located downstream of the fixing nip N in terms of the rotation direction R1, and the tension is more likely to be caused at a section located upstream of the fixing nip N.

The position detection section 5 includes a first position detection member 51 and a second position detection member 52. The first position detection member 51 and the second position detection member 52 (hereinafter, referred to simply as "position detection members 51 and 52") are each disposed at a central portion of the first rotatory body 1 in terms of the axial direction. The first position detection member 51 is located upstream of the fixing nip N in terms of the rotation direction R1 of the first rotatory body 1. The second position detection member 52 is located downstream of the fixing nip N. The position detection members 51 and 52 are each an optical sensor that senses a position.

The position detection members 51 and 52 detect positions La and Lb, respectively, of the outer circumferential surface 11 of the first rotatory body 1 in terms of the radial direction without touching the outer circumferential surface 11 of the first rotatory body 1. Hereinafter, the "positions La and Lb of the outer circumferential surface 11 of the first rotatory body 1 in terms of the radial direction" will be referred to simply as "radial positions La and Lb". More specifically, the position detection members 51 and 52 measure a distance to the first rotatory body 1 using light that is emitted therefrom to the outer circumferential surface 11 of the first rotatory body 1 and reflected off the outer circumferential surface 11 of the first rotatory body 1. The position detection members 51 and 52 continuously detect the radial positions La and Lb. The radial positions La and Lb can change due to for example tension, slack, deformation, or swelling of the outer circumferential surface 11 of the first rotatory body 1.

The control section 8 is mounted on a control board. The control section 8 includes a determination section 81. The determination section 81 includes a rotation determination section 81*a* and a failure determination section 81*b*. The determination section 81 determines the state of rotation of the first rotatory body 1 based on a result of detection by the position detection section 5. More specifically, the rotation determination section 81*a* determines the presence or absence of rotation of the first rotatory body 1 based on the presence or absence of a change in each of the radial positions La and Lb. When there are changes in both the radial positions La and Lb, for example, the rotation determination section 81*a* determines that the first rotatory body 1 is rotating. When there is no change in any of the radial positions La and Lb, the rotation determination section 81*a* determines that the first rotatory body 1 is not rotating. A "change" in a radial position refers to a difference between a radial position before the start of driving the second rotatory body 4 (reference position) and a radial position after the start of driving the second rotatory body 4. The failure determination section 81*b* determines that the first rotatory body 1 has a failure when a change in at least one of the radial positions La and Lb is greater than a predetermined threshold value after start of the heating by the heaters 6.

The control section 8 further includes a second rotatory body drive control section 82, a heater control section 83, and a notification section 84. The notification section 84 is connected with a display output section 85. The second rotatory body drive control section 82 controls the rotation of the second rotatory body 4 based on a result of determination by the determination section 81. More specifically, the second rotatory body drive control section 82 outputs a control signal S2 to the second rotatory body drive section 43 based on a determination signal S1 output from the determination section 81. The second rotatory body drive section 43 controls the rotational drive of the second rotatory body 4 to be stopped or continued based on the control signal S2 output from the second rotatory body drive control section 82.

The heater control section 83 controls heat generation of the heaters 6 based on a result of determination by the determination section 81. The heater control section 83 outputs an ON/OFF signal S3 to a switch in a power supply circuit for supplying power from a power source to the heaters 6 based on the determination signal S1 output from the determination section 81. The heater control section 83 outputs an ON signal S3 to control the heaters 6 to perform heating on the first rotatory body 1 (heat generation by the heaters 6). Likewise, the heater control section 83 outputs an OFF signal S3 to control the heaters 6 to not start heating when the heating is prior to being performed and to stop heating while the heating is being performed.

The notification section 84 outputs a control signal S4 to the display output section 85 based on the determination signal S1 output from the determination section 81. Thus, the display output section 85 is controlled to display or not display a warning indicating a failure in the fixing device 100. The display output section 85 notifies of the warning by lighting or text, for example. The notification section 84 may employ, instead of the display output section 85, a warning sounding section that issues a warning using sound or may employ a combination of the warning display and the warning sound.

As described above with reference to FIG. 1, the first position detection member 51 is located upstream of the fixing nip N along the rotation direction R1 of the first rotatory body 1 and detects a change in the radial position La of the outer circumferential surface 11 of the first rotatory body 1. On the other hand, the second position detection member 52 is located downstream of the fixing nip N and detects a change in the radial position Lb. The determination section 81 determines the state of rotation of the first rotatory body 1 based on results of the detection by the position detection members 51 and 52. Accordingly, a subtle change or an irregular change in each of the radial positions La and Lb can be independently detected when the rotation of the first rotatory body 1 is abnormal. It is possible to determine the presence or absence of rotation more accurately when the first rotatory body 1 is in a suspended state by comparing a change in the radial position La with the threshold value and a change in the radial position Lb with the threshold value in addition to just detecting the presence or absence of the rotation. As a result, it is possible to prevent an erroneous determination with respect to the state of rotation of the first rotatory body 1.

Second Embodiment

A fixing device 100 according to a second embodiment of the present disclosure will be described with reference to FIGS. 1-4. FIGS. 2A-2F are schematic side views illustrating the first rotatory body 1. The second rotatory body 4, the heaters 6, the pressure receiving member 2, the supporting member 3, and the toner TN are not shown in FIGS. 2A-2F in order to avoid overcomplicating the drawings. In the second embodiment, the determination section 81 described in the first embodiment determines the state of rotation of the first rotatory body 1 based on a difference between a direction of change in the radial position La and a direction of change in the radial position Lb.

The determination section 81 determines the state of rotation of the first rotatory body 1 based on a difference between a direction of change Da in the radial position La and a direction of change Db in the radial position Lb. A "direction of change" in a radial position is a radially outward direction (slack direction), a radially inward direction (tension direction), or no change relative to a reference position. The radially outward direction is a direction from the rotation axis of the first rotatory body 1 toward the outer circumferential surface 11 along the radial direction. The radially inward direction is a direction from the outer circumferential surface 11 toward the rotation axis of the first rotatory body 1 along the radial direction. Hereinafter, the radially outward direction is referred to as "X1 direction" and the radially inward direction is referred to as "X2 direction".

Figure 2A:
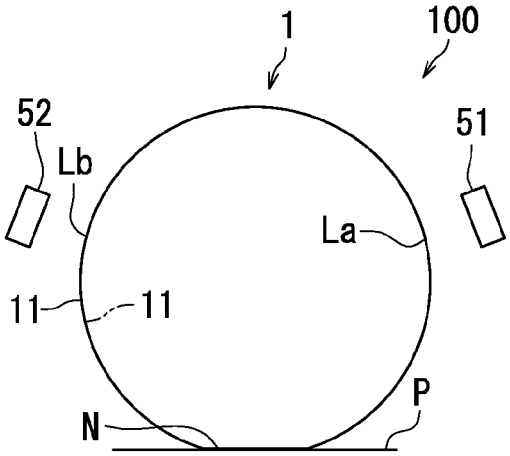
FIGS. 2A-2F are schematic side views illustrating a first rotatory body in a fixing device according to a second embodiment of the present disclosure.

Specific examples of the direction of change Da in the radial position La and the direction of change Db in the radial position Lb will be described with reference to FIGS. 2A-2F. FIG. 2A shows reference positions of the radial positions La and Lb. For example, a reference position upstream (downstream) of the fixing nip N is the radial position La (radial position Lb) detected by the first position detection member 51 (second position detection member 52) before the start of driving the second rotatory body 4. The dashed and double dotted lines in FIGS. 2B and 2D-2F each represent the outer circumferential surface 11 of the first rotatory body 1 at the time of the detection of the reference positions.

Figure 2B:
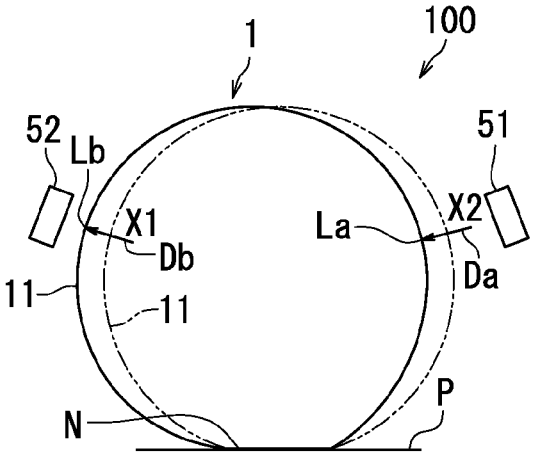

FIG. 2B represents the state of rotation of the first rotatory body 1 rotating at a constant rotation speed (steady rotation state). The direction of change Da in the radial position La is the X2 direction and the direction of change Db in the radial position Lb is the X1 direction during the steady rotation state. In this case, the radial positions La and Lb change in a regular manner and in different directions.

Figure 2C:
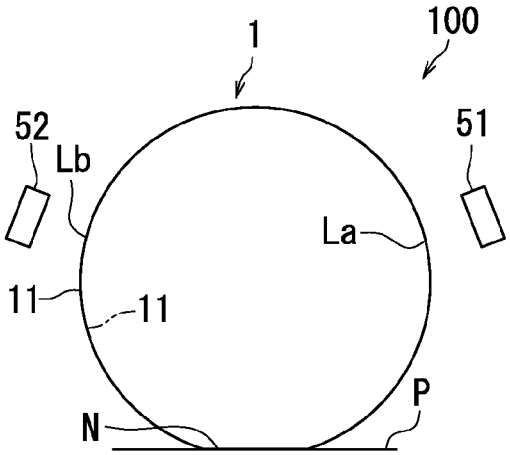

FIG. 2C illustrates a state in which the first rotatory body 1 fails to start rotating normally or a state in which the first rotatory body 1 is stopped immediately after the start of rotation. For example, neither of the radial positions La and Lb change before and after the detection of the reference positions. A typical situation in which the first rotatory body 1 is not heated by the heaters 6 is when there is no change in the radial positions as described above.

Figure 2D:
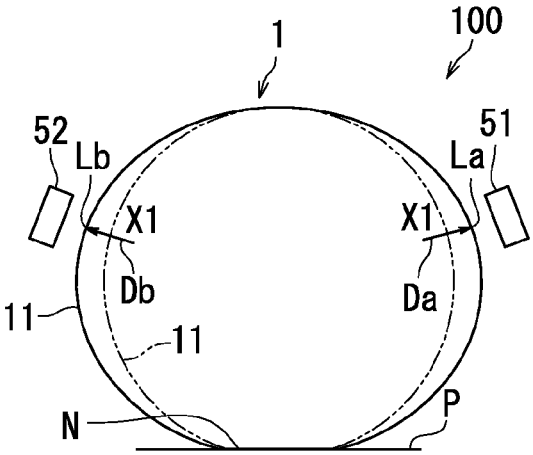
Figure 2E:
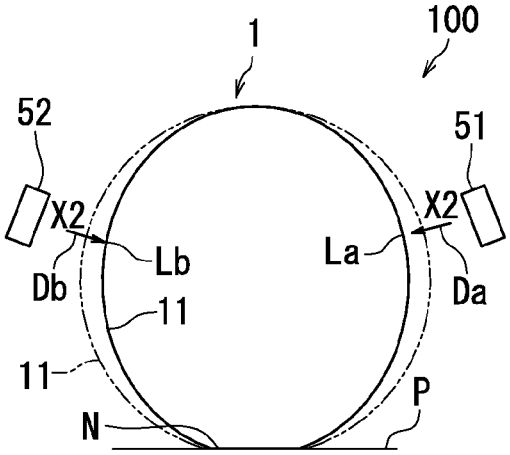

FIGS. 2D and 2E illustrate a state in which the first rotatory body 1 is rotating at a non-constant rotation speed (abnormal rotation state). FIG. 2D shows that the direction of change Da and the direction of change Db are the same, the X1 direction, during the abnormal rotation state. Likewise, FIG. 2E shows that the direction of change Da and the direction of change Db are the same, the X2 direction.

Figure 2F:
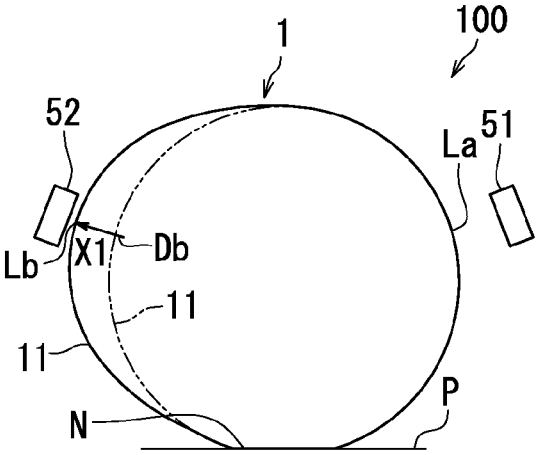

FIG. 2F illustrates the case where the first rotatory body 1 is heated by the heaters 6 while in a state in which the first rotatory body 1 fails to start rotating normally or in a state in which the first rotatory body 1 is stopped immediately after the start of rotation. In this case, the first rotatory body 1 may be partially deformed by the heat. That is, only one of the radial positions La and Lb changes. For example, only the direction of change Da in the radial position Lb is the X1 direction.

Figure 3:
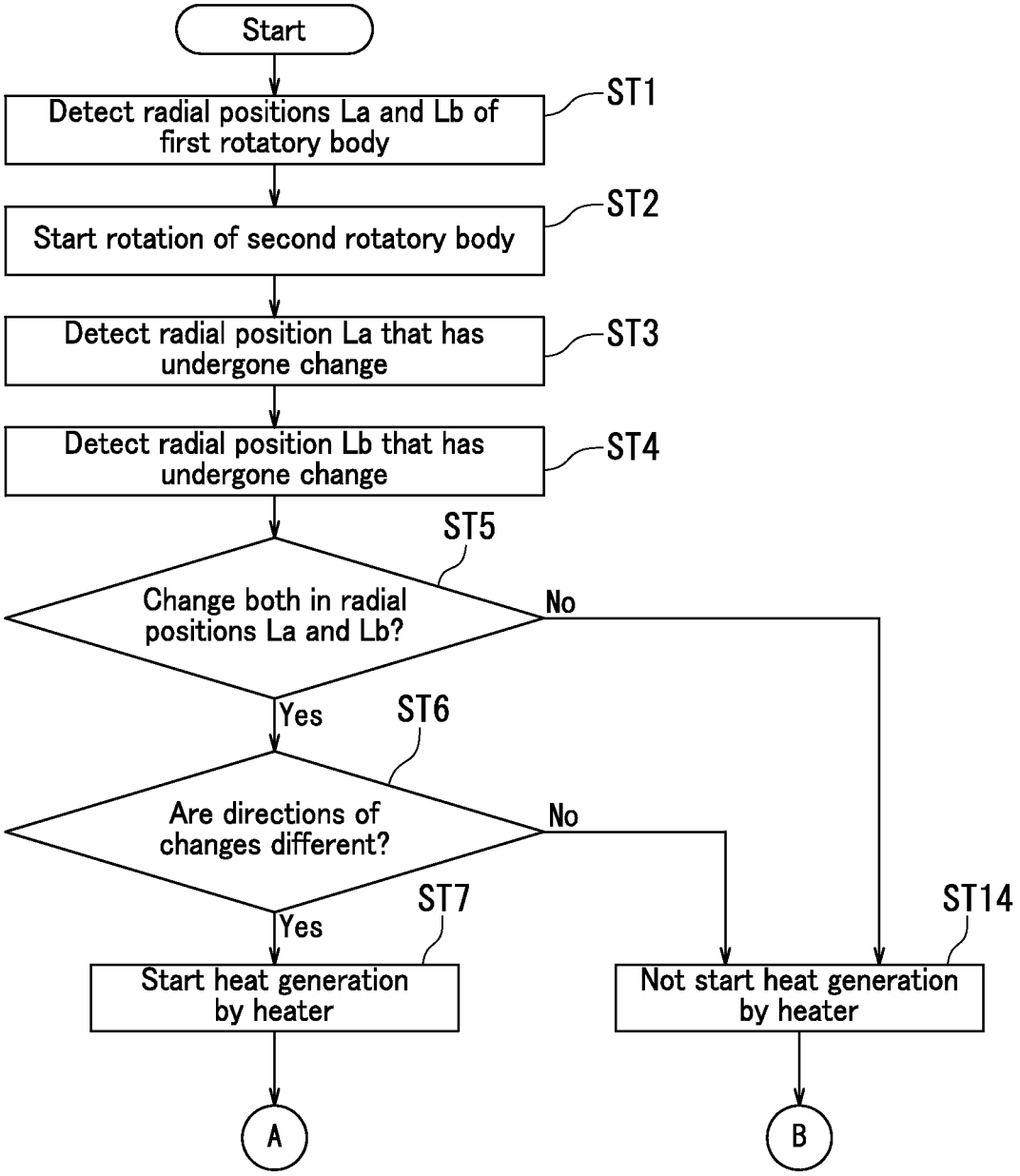
FIG. 3 is a flowchart illustrating a determination process that is performed in the fixing device according to the second embodiment of the present disclosure.
Figure 4:
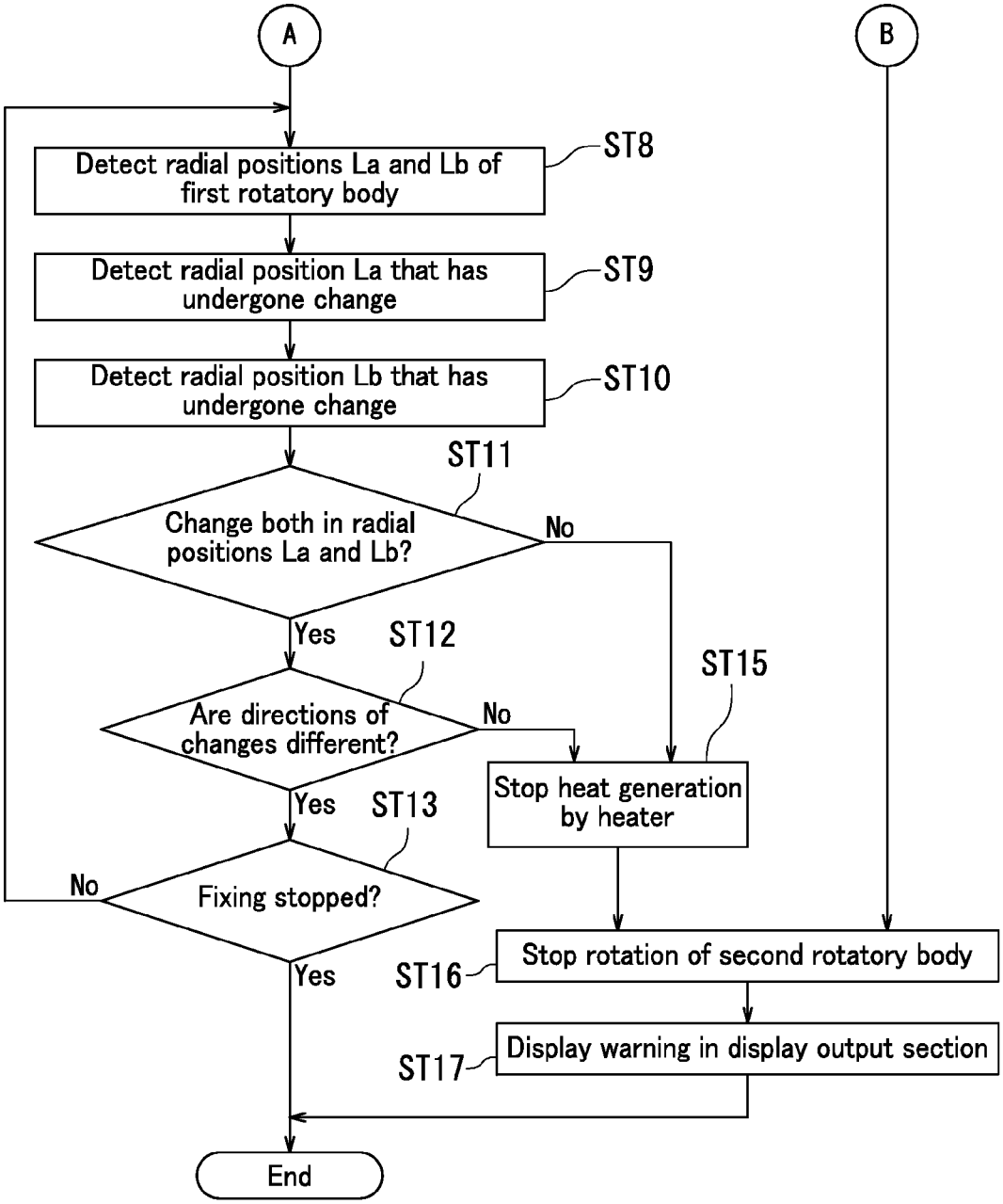
FIG. 4 is a flowchart illustrating the determination process that is performed in the fixing device according to the second embodiment of the present disclosure.

A specific example of a determination process by the rotation determination section 81*a* and the failure determination section 8*b* will be described with reference to FIGS. 3 and 4. FIGS. 3 and 4 show a flowchart illustrating the determination process that is performed in the fixing device 100.

In Step ST1, the radial positions La and Lb in the first rotatory body 1 are detected. More specifically, the first position detection member 51 detects the radial position La before the second rotatory body drive section 43 starts driving the second rotatory body 4, that is, while the first rotatory body 1 is in the suspended state. On the other hand, the second position detection member 52 detects the radial position Lb while the first rotatory body 1 is in the suspended state. The reference positions are for example the radial positions La and Lb before the start of driving the second rotatory body 4 (while the first rotatory body 1 is in the suspended state) (see FIG. 2A).

In Step ST2, rotation of the second rotatory body 4 is started. More specifically, the second rotatory body drive control section 82 controls the second rotatory body drive section 43 to rotationally drive the second rotatory body 4. The first rotatory body 1 is driven to rotate by the rotation of the second rotatory body 4.

In Step ST3, the radial position La that has undergone a change is detected. For example, the first position detection member 51 detects the radial position La after three seconds from the start of driving the second rotatory body 4 (start of rotation of the first rotatory body 1).

In Step ST4, as in Step ST3, a change in the radial position Lb is detected. Step ST3 and Step ST4 are performed at the same time.

In Step ST5 and Step ST6, the rotation determination section 81*a* determines the presence or absence of rotation of the first rotatory body 1 based on the direction of change Da in the radial position La and the direction of change Db in the radial position Lb. More specifically, first in Step ST5, the rotation determination section 81*a* determines that the first rotatory body 1 is rotating when a change is detected both in the radial positions La and Lb (Yes), and then the determination process proceeds to Step ST6 (see FIG. 2B, 2D, or 2E). When no change is detected either in the radial position La or Lb (No), the rotation determination section 81*a* determines that the first rotatory body 1 is not rotating, and then the determination process proceeds to Step ST14 (see FIG. 2C or 2F). When it is determined that the first rotatory body 1 is not rotating, the fixing device 100 may have a failure, and the failure needs to be handled appropriately.

A typical situation in which the rotation determination section 81*a* determines that the first rotatory body 1 is not rotating is when the first rotatory body 1 is not driven to rotate due to slippage between the outer circumferential surface 11 of the first rotatory body 1 and the outer circumferential surface 41 of the second rotatory body 4. In another typical situation, the second rotatory body 4 is not rotating at all due to a malfunction of the second rotatory body drive section 43.

When the direction of change Da in the radial position La and the direction of change Db in the radial position Lb are different (Yes) in Step ST6, the failure determination section 81*b* determines that the fixing device 100 does not have a failure and outputs a determination signal 51. Then, the determination process proceeds to Step ST7 (see FIG. 2B). When the direction of change Da and the direction of change Db are the same (No) in Step ST6, the failure determination section 81*b* determines that the fixing device 100 has a failure, and then the determination process proceeds to Step ST14 (see FIG. 2D or 2E).

In Step ST7, the heater control section 83 controls the heaters 6 to start heat generation. More specifically, the heater control section 83 outputs an ON signal S3 to the switch in the power supply circuit for supplying power from the power source to the heaters 6 based on the determination signal 51 output from the rotation determination section 81*a* or the failure determination section 81*b*. The heater control section 83 thereby controls the heaters 6 to start heating the first rotatory body 1 (heat generation). Thus, the fixing device 100 melts the toner TN adhering to the recording medium P passing through the fixing nip N. At the same time, the fixing device 100 fixes the toner TN on the recording medium P by applying pressure onto the recording medium P using the second rotatory body 4.

Subsequently, in Step ST8 to Step ST12, the rotation determination section 81*a* and the failure determination section 81*b* each make a determination while the heaters 6 are heating the first rotatory body 1. This determination process is the same as the determination process in Steps ST1 and ST3 to ST6.

More specifically, in Step ST8, the first position detection member 51 and the second position detection member 52 continuously detect the radial positions La and Lb, respectively, as in Step ST1. Step ST8 is different from Step ST1 in that the heaters 6 are heating the first rotatory body 1 in Step ST8. The reference positions in Step ST8 are the same as those in Step ST1. Alternatively, the reference positions may be the radial positions La and Lb after one second from the start of heating by the heaters 6, for example.

In Step ST9, the first position detection member 51 detects the radial position La that has undergone a change as in Step ST3.

In Step ST10, the second position detection member 52 detects the radial position Lb that has undergone a change as in Step ST4 and Step ST9.

When a change is detected both in the radial positions La and Lb (Yes) in Step ST11 as in Step ST5, the rotation determination section 81*a* determines that the first rotatory body 1 is rotating, and then the determination process proceeds to Step ST12. When there is no change in any of the radial positions La and Lb (No), the rotation determination section 81*a* determines that the first rotatory body 1 is not rotating, and then the determination process proceeds to Step ST15.

When the direction of change Da in the radial position La and the direction of change Db in the radial position Lb are different (Yes) in Step ST12 as in Step ST6, the failure determination section 81*b* determines that the fixing device 100 does not have a failure, and then the determination process proceeds to ST13. When the direction of change Da and the direction of change Db are the same (No), the failure determination section 81*b* determines that the fixing device 100 has a failure, and then the determination process proceeds to Step St15.

When the fixing by the fixing device 100 is suspended (Yes) in Step ST13, the determination process comes to an end. When the fixing is not suspended (No), the determination process returns to the beginning of Step ST8, and the position detection members 51 and 52 continue to detect the radial positions La and Lb, respectively. The reference positions in this step may be the same as those in Step ST1 or in Step ST8, or may be newly determined. Thus, the determination process is repeated until the fixing by the fixing device 100 is stopped.

In Step ST14, the heater control section 83 does not output a control signal S3 based on the determination signal 51 output from the rotation determination section 81*a* or the failure determination section 81*b*. Thus, the heaters 6 are kept from heating the first rotatory body 1. Alternatively, the heater control section 83 may control the heaters 6 to not heat the first rotatory body 1 by outputting a control signal S3. After completion of the control by the heater control section 83 in Step ST14, the determination process proceeds to Step ST16.

In Step ST16, the second rotatory body drive control section 82 outputs a control signal S2 to the second rotatory body drive section 43 to control the same to stop rotationally driving the second rotatory body 4 based on the determination signal S1 output from the rotation determination section 81*a* or the failure determination section 81*b*. After completion of the control by the second rotatory body drive control section 82 in Step ST16, the determination process proceeds to Step ST17.

In Step ST17, the notification section 84 outputs a control signal S4 to the display output section 85 based on the determination signal S1 output from the rotation determination section 81*a* or the failure determination section 81*b*, and thus controls the display output section 85 to display a warning. After Step ST17, the determination process comes to an end.

In Step ST15, the heater control section 83 outputs a control signal S3 based on the determination signal S1 output from the rotation determination section 81*a* or the failure determination section 81*b*. Thus, the power supply circuit is switched off. Then the power supply from the power source to the heaters 6 is stopped. The heating by the heaters 6 is stopped as described above.

In Step ST16, as described above, the second rotatory body drive control section 82 controls the second rotatory body drive section 43 to stop rotationally driving the second rotatory body 4. Thereafter, in Step ST17, the notification section 84 controls the display output section 85 to display a warning. After Step ST17, the determination process comes to an end.

As described above with reference to FIGS. 1 to 4, the determination section 81 determines the state of rotation of the first rotatory body 1 based on the difference between the direction of change Da in the radial position La and the direction of change Db in the radial position Lb. In case of abnormal rotation (or suspension) of the first rotatory body 1, therefore, it is possible to determine the state of rotation of the first rotatory body 1 based on irregular changes in the outer circumferential surface 11 of the first rotatory body 1.

When the determination section 81 determines that the rotation of the first rotatory body 1 is abnormal, the heater control section 83 controls the heaters 6 to not heat the first rotatory body 1. The second rotatory body drive control section 82 stops the second rotatory body 4 after confirming that the first rotatory body 1 is not being heated. In case of abnormal rotation of the first rotatory body 1, therefore, an anomaly in the first rotatory body 1 such as deformation that may be caused by the heaters 6 can be prevented early on.

Third Embodiment

A fixing device 100 according to a third embodiment of the present disclosure will be described with reference to FIGS. 1 and 5A-7. FIGS. 5A-5D are schematic side views illustrating the first rotatory body 1. As in FIGS. 2A-2F, the second rotatory body 4, the heaters 6, the pressure receiving member 2, the supporting member 3, and the toner TN are not shown in FIGS. 5A-5D. The third embodiment is different from the second embodiment in that the determination section 81 in the third embodiment makes a determination based on a sum of an amount of change in the radial position La and an amount of change in the radial position Lb whereas the determination section 81 in the second embodiment makes a determination based on a difference between the directions of changes.

The determination section 81 determines the state of rotation of the first rotatory body 1 based on a sum of an amount of change Qa in the radial position La that is detected by the first position detection member 51 and an amount of change Qb in the radial position Lb that is detected by the second position detection member 52. The term "amount of change" in a radial position refers to amplitude of each of the radial positions La and Lb relative to the reference position thereof. The dashed and double dotted lines in FIGS. 5A-5D each represent the outer circumferential surface 11 of the first rotatory body 1 at the time of the detection of the reference positions as described with reference to FIGS. 2A-2F.

Figure 5A:
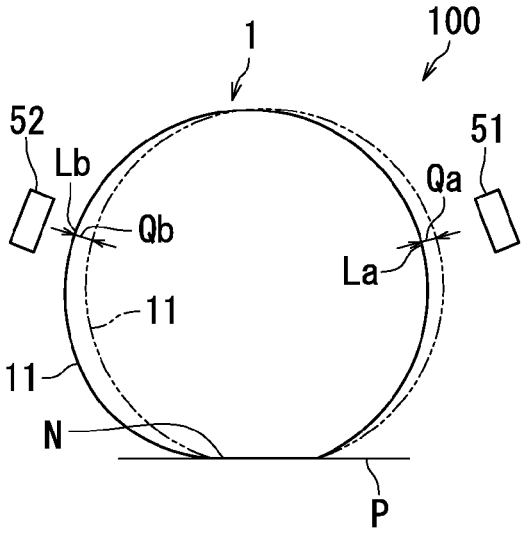
FIGS. 5A-5D are schematic side views illustrating a first rotatory body in a fixing device according to a third embodiment of the present disclosure.

Specific examples of the amounts of changes Qa and Qb will be described with reference to FIGS. 5A-5D. FIG. 5A illustrates a state of the first rotatory body 1 immediately after the start of rotation. The amounts of changes are not stable yet. For example, the amount of change Qa is 0.2 mm, the amount of change Qb is 0.3 mm, and the sum thereof is 0.5 mm.

Figure 5B:
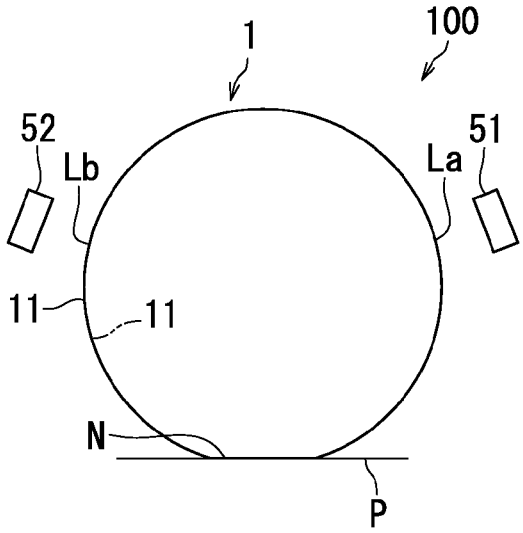

FIG. 5B illustrates a state of the first rotatory body 1 that is not being heated by the heaters 6 while in the suspended state as in FIG. 2C. For example, the amount of change Qa is 0 mm, and the amount of change Qb is 0 mm.

Figure 5C:
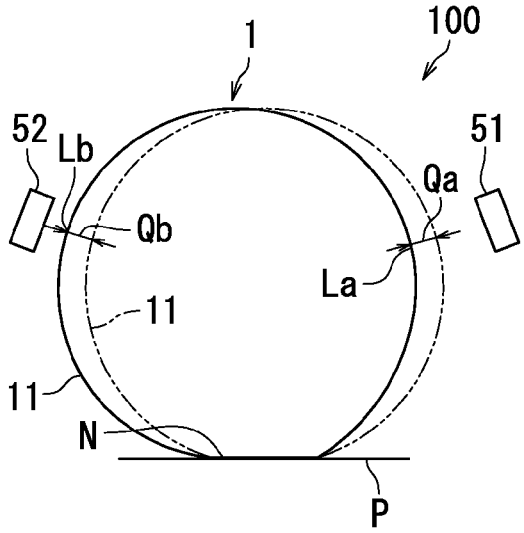

FIG. 5C illustrates a steady rotation state of the first rotatory body 1 as in FIG. 2B. During the steady rotation state, the difference between the amount of change Qa and the amount of change Qb is small and stable. For example, the amount of change Qa is 0.5 mm, the amount of change Qb is 0.5 mm, and the sum thereof is 1.0 mm.

Figure 5D:
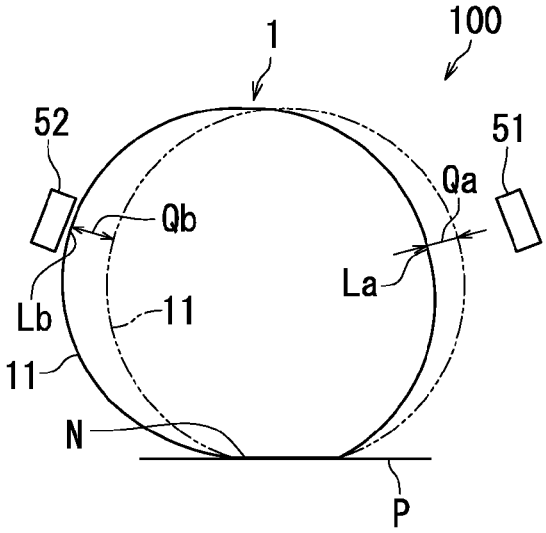

FIG. 5D illustrates an abnormal rotation state of the first rotatory body 1. During the abnormal rotation state, the difference between the amount of change Qa and the amount of change Qb tends to be large, each of which may be extremely large (or small) compared to the corresponding amount of change during the steady rotation state. For example, the amount of change Qa is 0.6 mm, the amount of change Qb is 1.0 mm, and the sum thereof is 1.6 mm.

Figure 6:
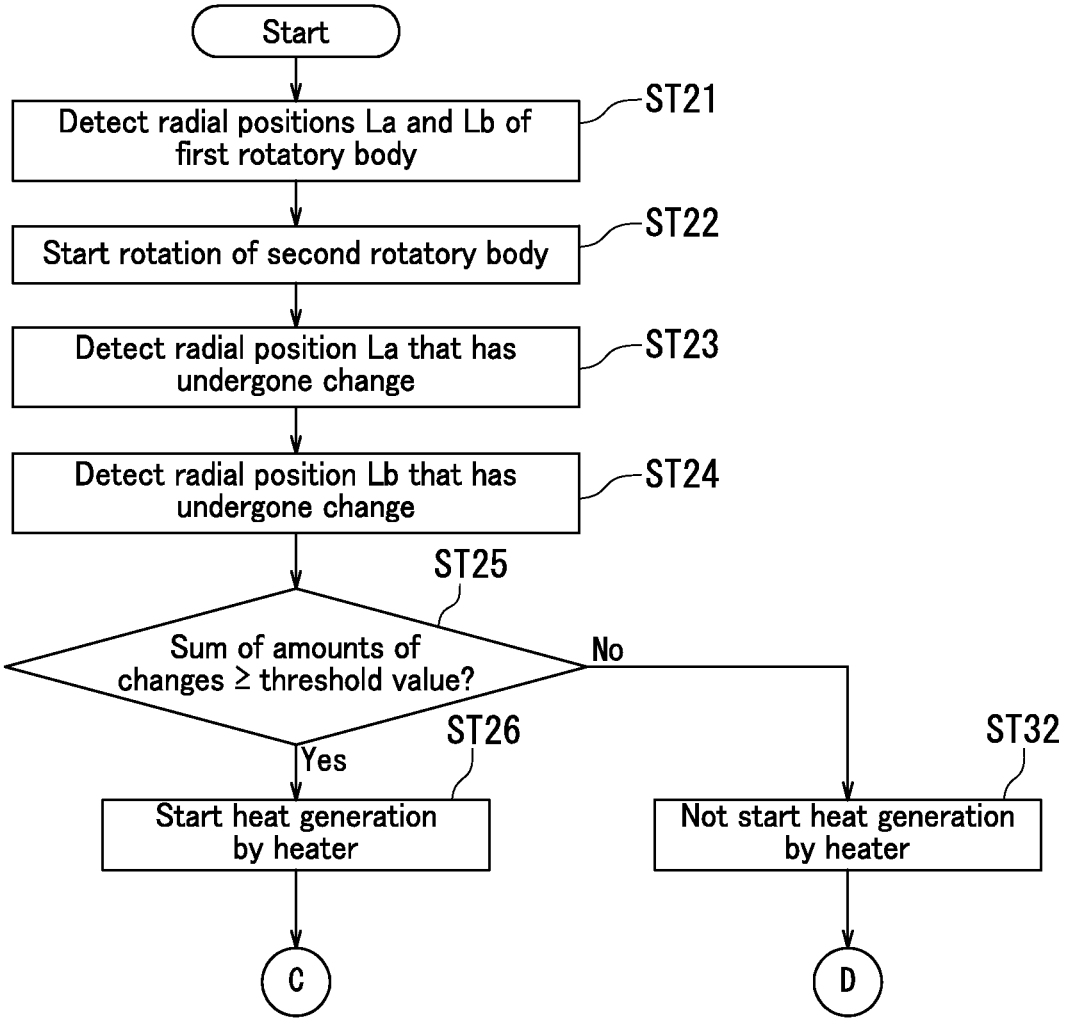
FIG. 6 is a flowchart illustrating a determination process that is performed in the fixing device according to the third embodiment of the present disclosure.
Figure 7:
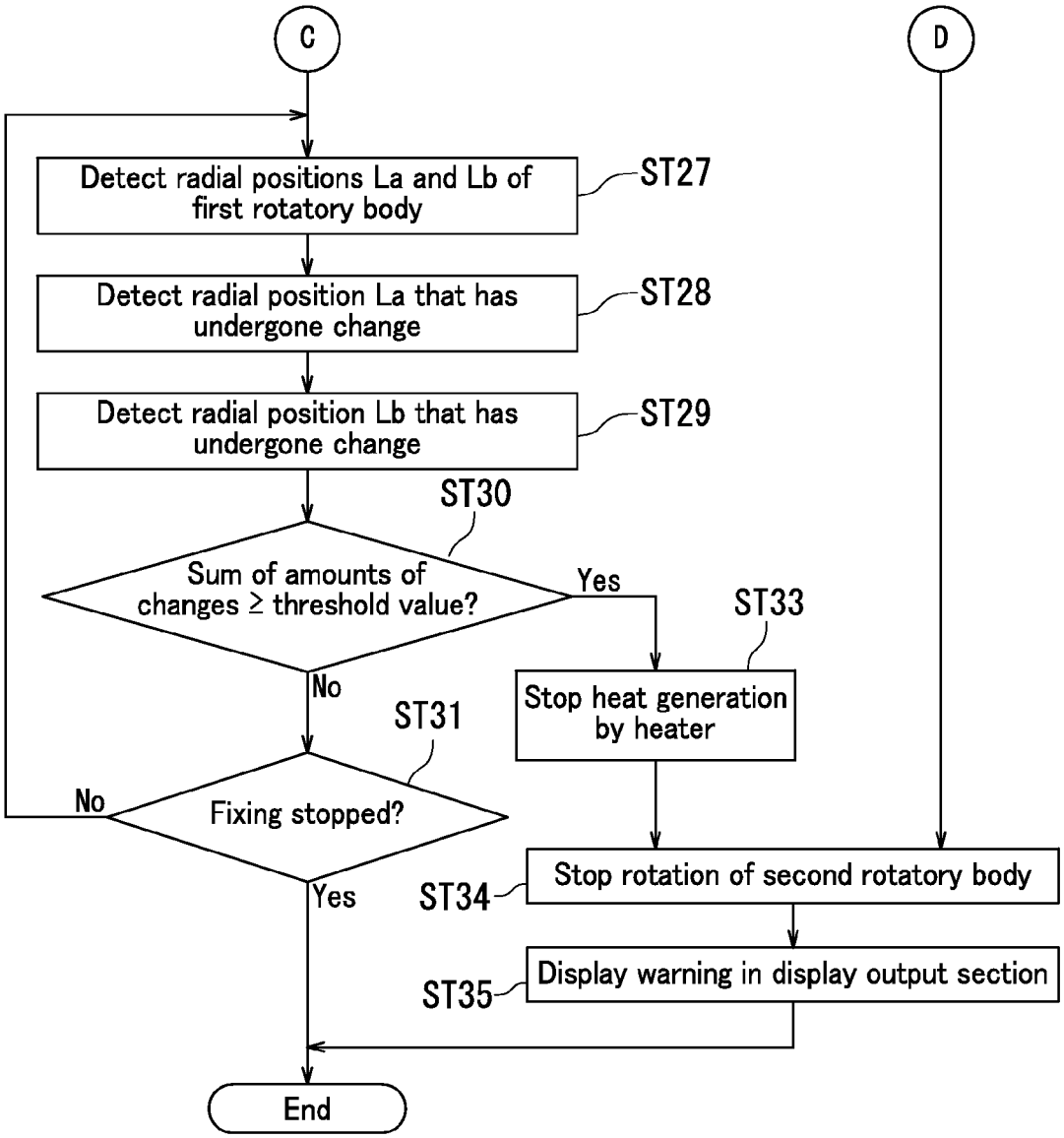
FIG. 7 is a flowchart illustrating the determination process that is performed in the fixing device according to the third embodiment of the present disclosure.

A specific example of the determination process by the rotation determination section 81*a* and the failure determination section 81*b* will be described with reference to FIGS. 6 and 7. FIGS. 6 and 7 show a flowchart illustrating the determination process that is performed in the fixing device 100. In order to clearly show a difference from the second embodiment, description of the same steps as in the determination process of the second embodiment is omitted.

Steps ST21 to ST24 correspond to Steps ST1 to ST4, respectively, described with reference to FIG. 3.

In Step ST25, the rotation determination section 81*a* determines whether or not the first rotatory body 1 is rotating based on the sum of the amount of change in the radial position La and the amount of change in the radial position Lb. More specifically, when the sum of the amount of change Qa and the amount of change Qb is equal to or greater than a predetermined threshold value (Yes), the rotation determination section 81*a* determines that the first rotatory body 1 is rotating and outputs a determination signal S1. Then, the determination process proceeds to Step ST26. On the other hand, when the sum of the amount of change Qa and the amount of change Qb is smaller than the threshold value (No), the rotation determination section 81*a* determines that the first rotatory body 1 is rotating at a lowered rotation speed (or not rotating) due to a failure therein and outputs a determination signal S1. Then, the determination process proceeds to Step ST32.

In a configuration in which the threshold value in Step ST25 is 0.4 mm, for example, the sum of the amount of change Qa and the amount of change Qb of 0.5 mm as in the description made with reference to FIG. 5A satisfies the condition that the sum is equal to or greater than the threshold value. Accordingly, it is determined that the first rotatory body 1 is rotating. Since the determination is made by taking into account of the amount of change Qb, misdetection is less likely to occur even when the amount of change Qa is very small (0.2 mm). When the sum of the amount of change Qa and the amount of change Qb is 0 mm, which is smaller than the threshold value, as in the description made with reference to FIG. 5B, it is determined that the first rotatory body 1 is not rotating due to a failure.

The threshold value is predetermined in view of functional deterioration of the fixing device 100 due to deformation of the first rotatory body 1. More specifically, the threshold value is preferably determined so as to avoid a situation in which sufficient sliding cannot be ensured between the inner circumferential surface 12 of the first rotatory body 1 and the pressure receiving member 2, a situation in which the first rotatory body 1 fails to rotate because of slippage between the outer circumferential surface 41 of the second rotatory body 4 and the outer circumferential surface 11 of the first rotatory body 1 at the fixing nip N, and a situation in which the fixing nip N is not formed, due to the deformation of the first rotatory body 1. In addition, the threshold value is preferably determined in view of a design margin.

Steps ST26 to ST29 correspond to Steps ST7 to ST10, respectively, described with reference to FIGS. 3 and 4.

In Step ST30, the failure determination section 81*b* determines whether or not the first rotatory body 1 has a failure based on the sum of the amount of change Qa in the radial position La and the amount of change Qb in the radial position Lb. Step ST30 is different from Step ST25 in that heating of the first rotatory body 1 by the heaters 6 (heat generation by the heaters 6) is performed in Step ST30. Accordingly, abnormal rotation of the first rotatory body 1 is determined using a threshold value set to be greater than the threshold value in Step ST25. More specifically, when the sum of the amount of change Qa and the amount of change Qb is smaller than the predetermined threshold value (No), the failure determination section 81*b* determines that the first rotatory body 1 does not have a failure and outputs a determination signal S1. Then, the determination process proceeds to Step ST31. On the other hand, when the sum of the amount of change Qa and the amount of change Qb is equal to or greater than the predetermined threshold value (Yes), the failure determination section 81*b* determines that the first rotatory body 1 has a failure and outputs a determination signal S1. Then, the determination process proceeds to Step ST33.

In a configuration in which the threshold value in Step ST30 is 1.5 mm, for example, the sum of the amount of change Qa and the amount of change Qb of 1.0 mm as in the description made with reference to FIG. 5C is smaller than the threshold value. Accordingly, it is determined that the first rotatory body 1 does not have a failure. When the sum of the amount of change Qa and the amount of change Qb is 1.6 mm, which satisfies the condition that the sum is equal to or greater than the threshold value, as in the description made with reference to FIG. 5D, it is determined that the rotation of the first rotatory body 1 is abnormal. Since the determination is made by taking into account the amount of change Qb, abnormal rotation is effectively found even when the amount of change Qa is 0.6 mm, which is close to the amount of change (0.5 mm) in the case of steady rotation.

A typical situation in which the rotation determination section 81*a* determines that the sum of the amount of change Qa and the amount of change Qb is equal to or greater than the predetermined threshold value is when for some reason the first rotatory body 1 is deformed, the first rotatory body 1 is distorted, or the outer circumferential surface of the first rotatory body 1 has irregularities.

Steps ST31 to ST35 correspond to Steps ST13 to ST17, respectively, described with reference to FIGS. 3 and 4. After Step ST31 or Step ST35, the determination process comes to an end.

As described with reference to FIGS. 1 and 5A-7, the determination section 81 detects the amount of change in the radial position La and the amount of change in the radial position Lb. The determination section 81 determines the state of rotation of the first rotatory body 1 based on the sum of the amount of change Qa in the radial position La and the amount of change Qb in the radial position Lb. Thus, the presence or absence of the rotation can be determined before the heaters 6 start heating using very small amounts of changes in the radial positions La and Lb. In addition, the possibility of an erroneous determination as to the presence or absence of an anomaly can be reduced even when the amount of change in one of the radial position La and the radial position Lb is great and the amount of change in the other is small due to abnormal rotation of the first rotatory body 1 after the heaters 6 have started heating.

A general rotatory heating belt is known to be likely to have slack and tension of the outer circumferential surface to an extremely small extent or to an extremely great extent immediately after the start of rotation (likely to flutter). Such belt fluttering is not particularly abnormal. If the rotation of the rotatory heating belt in a cool state is suspended for a certain period of time, for example, the rotatory heating belt loses flexibility and is marked at the fixing nip to have irregularities. If the rotatory heating belt starts rotating in this state, the belt is likely to flutter. By contrast, the flexibility of the rotatory heating belt is increased and the rotation thereof gradually becomes smooth as the rotatory heating belt is heated after starting rotation (as the temperature of the rotatory heating belt is increased). As a result, the degree of slack or tension of the rotatory heating belt gradually becomes stable. The fixing device 100 according to the third embodiment of the present disclosure is capable of determining the presence or absence of rotation of the first rotatory body 1 (rotatory heating belt) with small amounts of changes in the radial positions La and Lb in Step ST25. Thus, the possibility of an erroneous determination is reduced even in case of belt fluttering. Preferably, the determination of abnormal rotation is designed so that the determination is made while the rotation of the first rotatory body 1 is not in a just-started state.

Figure 8A:
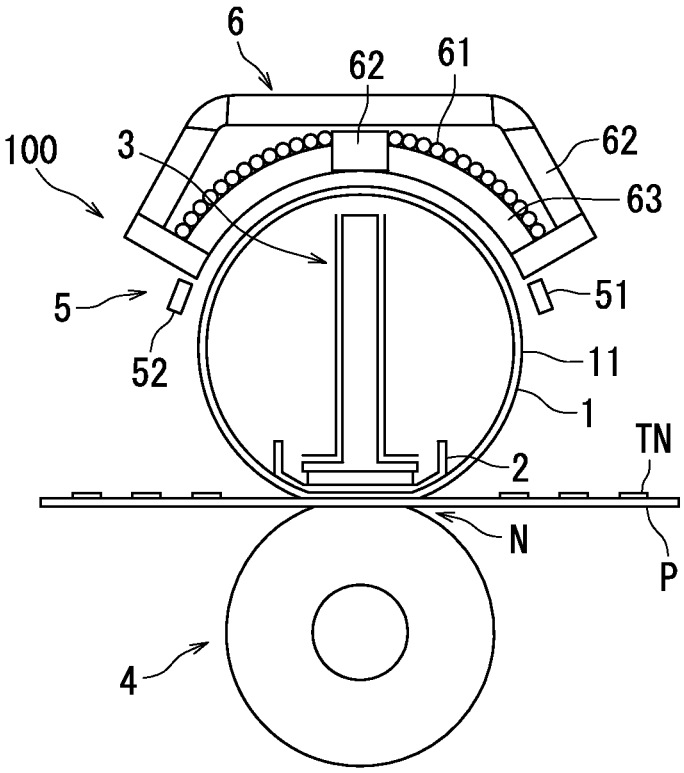
FIGS. 8A and 8B are schematic side views illustrating variations of the fixing devices according to the first to third embodiments of the present disclosure.
Figure 8B:
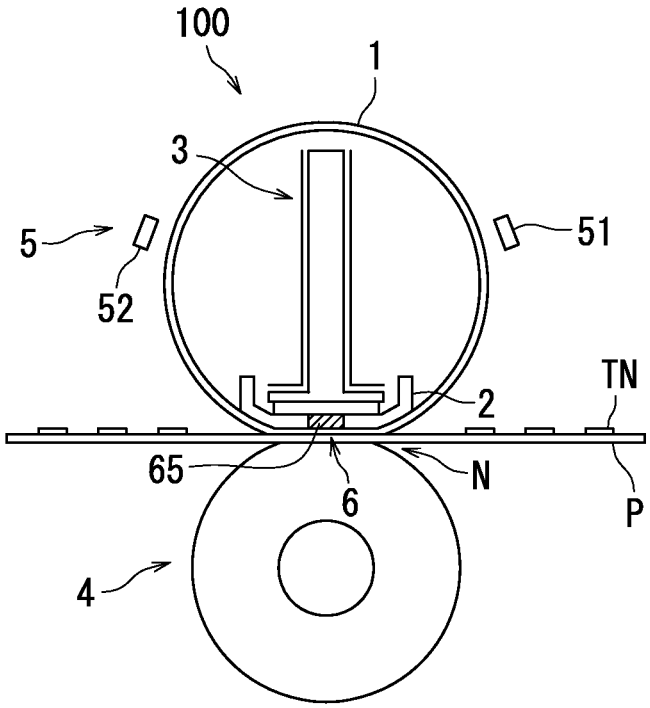

The heater 6 as illustrated in FIGS. 8A and 8B may include an electromagnetic induction coil 61 or a resistance heating element 65. FIGS. 8A and 8B are schematic side views illustrating variations of the fixing device 100.

The heater 6 in FIG. 8A includes the electromagnetic induction coil 61, a magnetic core 62, and a bobbin 63 that are located outside of the first rotatory body 1. The first rotatory body 1 further includes an electromagnetic induction heat generation layer. The heater 6 extends in a width direction of the first rotatory body 1 and is disposed opposite to the first rotatory body 1 so as to surround a substantially half of the outer circumferential surface 11. A magnetic flux generated through the electromagnetic induction coil 61 causes the electromagnetic induction heat generation layer to generate heat, and thus causes heating of the first rotatory body.

The heater 6 in FIG. 8B includes the resistance heating element 65 disposed in the vicinity of the fixing nip N. The heater 6 is for example a ceramic heater. The resistance heating element 65 is held by the pressure receiving member 2.

Fourth Embodiment

Figure 9:
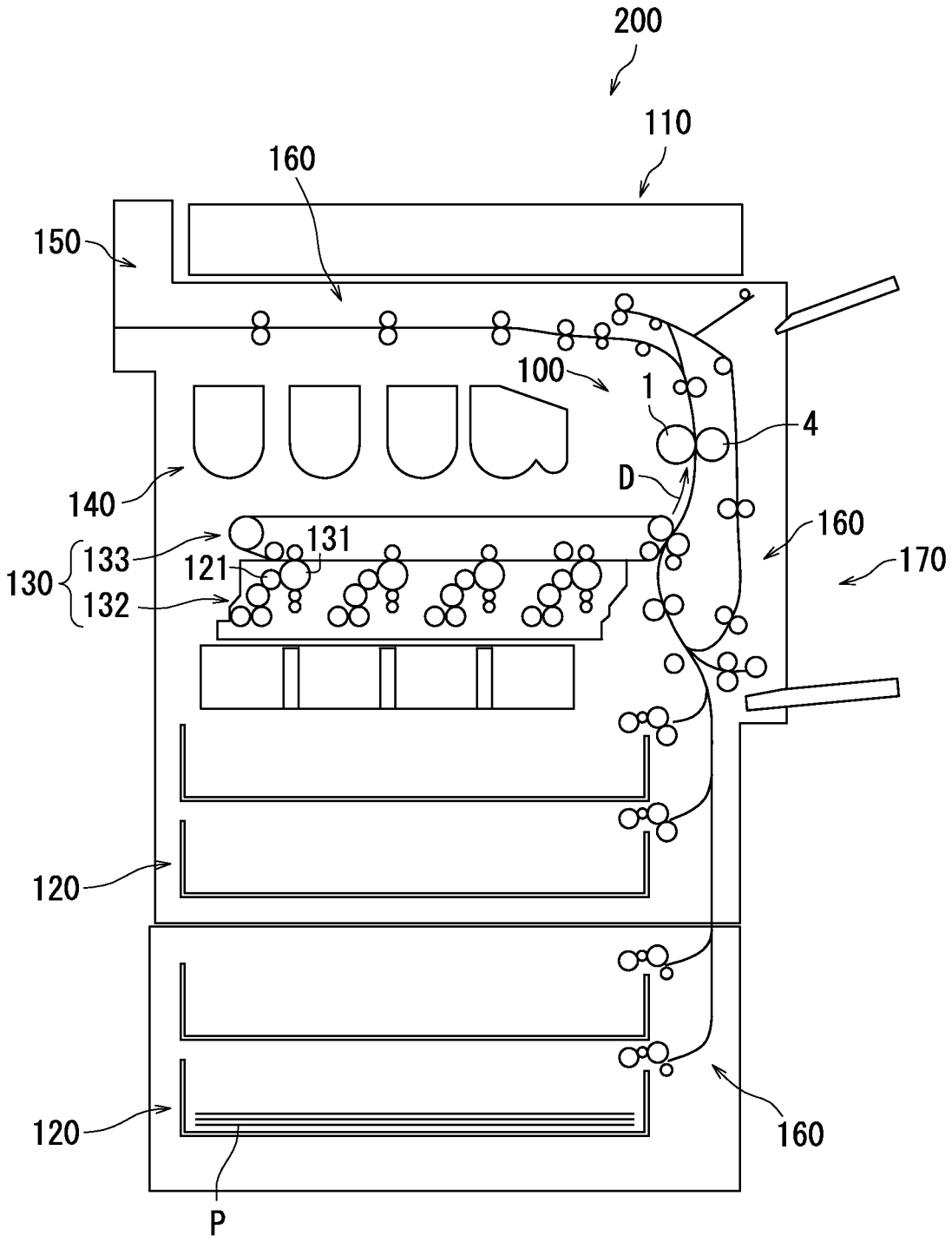
FIG. 9 is a schematic diagram illustrating an image forming apparatus according to a fourth embodiment of the present disclosure.

FIG. 9 is a schematic diagram illustrating an image forming apparatus 200 according to a fourth embodiment of the present disclosure. The image forming apparatus 200 can be a copier, a printer, a facsimile machine, or a multifunction peripheral that implements functions of the aforementioned machines. Hereinafter, the present disclosure will be described using a copier as an example of the image forming apparatus 200, but the present disclosure is not limited thereto. The image forming apparatus 200 includes the fixing device 100, an image reading section 110, and an image forming section 170. The image forming section 170 has sheet feed cassettes 120, an imaging section 130, a toner replenishment device 140, a sheet ejecting section 150, and a sheet conveyance section 160. The image forming section 170 forms an image based on image data that is read by the image reading section 110.

The sheet feed cassettes 120 each store therein a recording medium P for printing. In a copying operation, the recording medium P in a sheet feed cassette 120 is conveyed by the sheet conveyance section 160 to be ejected from a sheet ejecting section 150 after passing through the imaging section 130 and the fixing device 100.

The imaging section 130 forms a toner image on the recording medium P. The imaging section 130 includes photosensitive members 131, developing devices 132, and a transfer device 133.

An electrostatic latent image is formed on each photosensitive member 131 with laser light based on an electronic signal representing an original image generated in the image reading section 110. Each developing device 132 has a developing roller 121. Each developing roller 121 is used to supply toner to the corresponding photosensitive member 131 to develop the electrostatic latent image. Thus, a toner image is formed on each photosensitive member 131. The toner replenishment device 140 replenishes the respective developing devices 132 with toner.

The transfer device 133 transfers the toner images formed on the respective photosensitive members 131 to the recording medium P.

The fixing device 100 applies heat and pressure onto the recording medium P to melt and fix, on the recording medium P, the unfixed toner images formed in the imaging section 130.

So far, the embodiments of the present disclosure have been described with reference to the drawings (FIGS. 1-9). However, the present disclosure is not limited to the above-described embodiments and can be practiced in various ways within the scope not departing from the essence of the present disclosure (e.g., as described below in sections (1)-(4)). The drawings are intended to emphasize the components in a schematic manner to assist with understanding. The thickness, the length, and the number of the components illustrated, and also spaces therebetween, are not true to scale for diagrammatic purposes. The material, the shape, the dimensions, and the like of each component shown in the above-described embodiments are only exemplary and do not represent any particular limitations. Various alternations can be made thereto within the scope not substantially departing from the effect of the present disclosure.

(1) In the configurations of the fixing device 100 described with reference to FIGS. 1-9, the second rotatory body 4 (pressure roller) is rotationally driven and the first rotatory body 1 (rotatory heating belt) is driven to rotate by the rotation of the second rotatory body 4. However, the present disclosure is not limited to the described configurations. For example, the first rotatory body 1 may be rotationally driven and the second rotatory body 4 may be driven to rotate by the rotation of the first rotatory body 1. In addition, a pressure rotatory body formed from an endless flexible belt may be used as a pressure roller instead of the second rotatory body 4.

(2) In the configurations of the fixing device 100 described with reference to FIGS. 1-9, the rotational drive control of the second rotatory body 4 and the heat generation control of the heaters 6 are performed automatically based on the determination signal 51 output from the rotation determination section 81*a*. However, the present disclosure is not limited to the described configurations. For example, a person who has read a warning displayed by the display output section 85 may manually perform the rotational drive control of the second rotatory body 4 and the heat generation control of the heaters 6.

(3) The number and the position of the heaters 6 are not limited to the configuration of the fixing device 100 described with reference to FIGS. 1-9. Furthermore, although configurations have been described in which the heaters 6 include a halogen heater, the electromagnetic induction coil 61, or the resistance heating element 65, for example, the present disclosure is not limited to such configurations.

(4) The configuration of the fixing device 100 described with reference to FIGS. 1-9 includes one first position detection member 51 located upstream of the fixing nip N and one second position detection member 52 located downstream of the fixing nip N. However, the fixing device 100 of the present disclosure is effective as long as at least one first position detection member 51 and at least one second position detection member 52 are included. For example, the position detection section 5 may include two first position detection members 51 and two second position detection members 52. In addition, the positions thereof in the axial direction are not particularly limited. For example, the first position detection member 51 and the second position detection member 52 may be configured to be movable in the axial direction of the first rotatory body 1. In this configuration, the failure determination section 81*b* can determine the presence or absence of a failure in the first rotatory body 1 at a plurality of positions along the axial direction of the first rotatory body 1.

What is claimed is:

1. A fixing device for fixing a toner on a recording medium, comprising:

a first rotatory body in the form of an endless belt, the first rotatory body being rotatable in a circumferential direction thereof;

a heater configured to heat the first rotatory body;

a pressure receiving member disposed within the first rotatory body and configured to be in contact with an inner circumferential surface of the first rotatory body;

a supporting member disposed within the first rotatory body and configured to support the pressure receiving member;

a second rotatory body disposed opposite to the pressure receiving member with the first rotatory body therebetween, the second rotatory body being rotatable, the second rotatory body and the pressure receiving member providing a fixing nip therebetween where the recording medium becomes sandwiched;

a position detection section configured to detect a position of an outer circumferential surface of the first rotatory body in terms of a radial direction of the first rotatory body; and a determination section configured to determine a state of rotation of the first rotatory body based on a result of detection by the position detection section, wherein the position detection section includes a first position detection member located at a location upstream of the fixing nip in terms of a rotation direction of the first rotatory body and a second position detection member located at a location downstream of the fixing nip in terms of the rotation direction.

2. The fixing device according to claim 1, wherein the first position detection member detects, at the location thereof, a direction of change in the position of the outer circumferential surface, the second position detection member detects, at the location thereof, a direction of change in the position of the outer circumferential surface, and the determination section determines the state of rotation of the first rotatory body based on a difference between the direction of change detected by the first position detection member and the direction of change detected by the second position detection member.

3. The fixing device according to claim 2, wherein the determination section:

determines that the state of rotation is normal when the direction of change detected by the first position detection member and the direction of change detected by the second position detection member are different; and determines that the state of rotation is abnormal when the direction of change detected by the first position detection member and the direction of change detected by the second position detection member are the same.

4. The fixing device according to claim 1, wherein the first position detection member detects, at the location thereof, an amount of change in the position of the outer circumferential surface, the second position detection member detects, at the location thereof, an amount of change in the position of the outer circumferential surface, and the determination section determines the state of rotation based on a sum of the amount of change detected by the first position detection member and the amount of change detected by the second position detection member.

5. The fixing device according to claim 1, wherein the first position detection member detects, at the location thereof, the position of the outer circumferential surface, the second position detection member detects, at the location thereof, the position of the outer circumferential surface, and the determination section determines that the state of rotation is abnormal when there is a change in only one of the position detected by the first position detection member and the position detected by the second position detection member.

6. The fixing device according to claim 1, wherein the heater includes any one of a halogen heater, an electromagnetic induction coil, and a resistance heating element.

7. The fixing device according to claim 1, further comprising:

a heater control section configured to control heat generation by the heater based on a result of determination by the determination section; and a second rotatory body drive control section configured to control rotation of the second rotatory body based on a result of determination by the determination section.

8. An image forming apparatus comprising:

the fixing device according to claim 1; and an image forming section configured to transfer the toner to the recording medium, wherein the fixing device fixes the toner on the recording medium.

* * * * *